United States Patent [19]

Bellis et al.

[11] Patent Number: 4,849,163

[45] Date of Patent: Jul. 18, 1989

[54] PRODUCTION OF FLAT PRODUCTS FROM PARTICULATE MATERIAL

[75] Inventors: John Bellis, Borras Park; Nigel J. Brooks, Greenfield, both of United Kingdom

[73] Assignee: Mixalloy Limited, United Kingdom

[21] Appl. No.: 93,883

[22] Filed: Sep. 8, 1987

[30] Foreign Application Priority Data

Sep. 9, 1986 [GB] United Kingdom ..... 8621712

[51] Int. Cl.[4] ..... B22F 3/00

[52] U.S. Cl. ..... 419/3; 264/112; 264/125; 419/8; 419/28; 419/36; 419/37; 419/40

[58] Field of Search ..... 419/3, 8, 28, 36, 37, 419/40; 264/125, 112

[56] References Cited

U.S. PATENT DOCUMENTS

| | | | |
|---|---|---|---|
| 4,114,251 | 9/1978 | Southern et al. | 419/3 |
| 4,391,772 | 7/1983 | Bonnor et al. | 419/37 |
| 4,592,780 | 6/1986 | Davies et al. | 419/3 |
| 4,602,954 | 7/1986 | Davies et al. | 419/3 |
| 4,617,054 | 10/1986 | Mathers | 419/3 |
| 4,622,189 | 11/1986 | Bellis et al. | 419/3 |
| 4,626,406 | 12/1986 | Poole | 419/37 |

FOREIGN PATENT DOCUMENTS

| | | |
|---|---|---|
| 1212681 | 11/1967 | United Kingdom . |
| 1257032 | 12/1971 | United Kingdom . |
| 1257033 | 12/1971 | United Kingdom . |
| 1301093 | 12/1972 | United Kingdom . |
| 1341544 | 12/1973 | United Kingdom . |

*Primary Examiner*—Stephen J. Lechert Jr.

*Attorney, Agent, or Firm*—Kinney & Lange P.A.

[57] ABSTRACT

A process for producing flat products from gas atomised particulate material comprises the steps of forming a relatively smooth castable slurry comprising a suspension of such particulate material in a solution of film-forming binder material, depositing a coating of the slurry onto a substrate or support surface and drying the coating to form a flexible flat product. The dried flat product may be bonded onto the substrate or support surface by the drying process or, alternatively, may be removed therefrom and roll-bonded to a suitable substrate for subsequent compaction and sintering.

4 Claims, No Drawings

PRODUCTION OF FLAT PRODUCTS FROM PARTICULATE MATERIAL

BACKGROUND OF THE INVENTION

1. Field of the Invention

This invention relates to a process for producing flat products from particulate material and to flat products produced by such a process. By the term "flat products" it is meant products in strip, sheet or like form or products produced therefrom which have retained a generally flat appearance.

2. Description of the Prior Art

A process for the production of strip from metal powder is known in which a suspension of powdered metal in a solution of a film-forming binder material in water is coated in the form of a slurry onto a support surface, dried and removed from the support surface as a thin, flexible strip. This strip is subsequently compacted within a rolling mill and sintered to produce the final strip product.

Hitherto, process operators have favoured the use of powders consisting, essentially, of irregular shaped particles as are produced, for example, by water atomisation techniques.

It has been established that these irregular shaped particles bind together more effectively than do spherical particles thereby producing relatively higher green strengths in the compacted strip. In addition the increased surface area of irregular particles provides greater particle contact area after compaction thereby increasing the surface area over which diffusion processes can occur during subsequent sintering resulting in greater strength for the sintered strip.

In the alternative gas atomisation process, the cooling rate of the molten droplets produced during atomisation is sufficiently slow for the surface tension forces to spheroidise the particles before solidification. Where materials having relatively slow freezing points are required, e.g. braze materials, this effect is exaggerated.

Gas-atomised powders are generally more widely available than water atomised powders and also tend to contain less impurity since they are conventionally atomised using pure inert gases such as argon. Water atomised powders are more likely to bo oxidised or otherwise contaminated by dissociation products of water, or any dissolved impurities the water may contain.

There are, therefore, advantages which would accrue from the use of gas-atomised powders for the production of certain strip products where the absence of impurities is important, e.g. strips for use in brazing applications if problems associated with compaction and sintering of strip produced from gas-atomised powders can be overcome. One particular problem which does not occur during the roll compaction process arises as a consequence of the fact that spherical powder particles produce a strip in which the particle content tends to "flow" producing large extensions with relatively little particle interaction. Hence the green strength of the compacted strip and surface area contact of the particulate content of the strip are both low resulting in a strip having inadequate physical properties following first compaction and first sintering.

The present invention sets out to provide a process in which flat products can be produced from a slurry containing spherical gas atomised powders.

SUMMARY OF THE INVENTION

The invention is directed to a process for producing flat products from gas atomised particulate material. The process includes the steps of casting onto a substrate a relatively smooth slurry comprising a suspension of gas atomised particulate material in a solution of a film-forming binder material in water, drying the coating, roll bonding the dried coating to the substrate, and sintering the roll-bonded product. In another embodiment the process includes the steps of forming a relatively smooth castable slurry comprising a suspension of gas atomised particulate material in a solution of film-forming binder material in water, depositing the slurry onto a support surface, drying the coating and removing the dried coating from the support surface as a flexible flat product, with the flexible flat product then roll-bonded to a suitable substrate, and sintering the roll-bonded product.

DETAILED DESCRIPTION OF THE PREFERRED EMBODIMENTS

According to the present invention in one aspect, there is provided a process for producing flat products from gas atomised particulate material which comprises the steps of forming a relatively smooth castable slurry comprising a suspension of such particulate material in a solution of a film-forming binder material, depositing a coating of the slurry onto a substrate and drying the coating to bond the dried coating onto the substrate.

The flat product may be rolled within a mill to enhance the bond between the coating and the substrate.

According to the present invention in another aspect, there is provided a process for producing flat products from gas atomised particulate material which comprises forming a relatively smooth castable slurry comprising a suspension of such particulate material in a solution of a film-forming binder material in water, depositing a coating of the slurry onto a support surface, drying the coating and removing the dried coating from the support surface as a flexible flat product, and roll-bonding the flexible flat product to a suitable substrate for subsequent compaction and sintering.

According to the present invention in another aspect, there is provided a process for producing flat products from gas atomised particulate material which comprises casting onto a substrate a relatively smooth slurry comprising a suspension of such particulate material in a solution of a film-forming binder material in water, drying the cast slurry coating, roll-bonding the dried coating to the substrate, and sintering the roll-bonded product.

The substrate may subsequently be removed by, for example, a chemical pickling or electro-chemical process or may form an integral part of the finished strip. In the latter case, a flexible flat product may be roll-bonded to one side only of a substrate or to each side thereof.

The flat product produced by the process may comprise braze material.

Examples of substrate material include pure iron strip, nickel and nickel alloy strip.

According to the present invention in another aspect, there is provided a flat product produced by a process as described in any one of the preceding four paragraphs.

According to the present invention in a still further aspect, there is provided ar oll-compacted sintered flat product produced from gas atomised particulate material.

The invention will now be described by way of example only with reference to the following Examples of processes in accordance with the invention.

EXAMPLE 1

A pre-alloyed gas-atomised nickel-based powder of composition by weight 22.5% manganese, 7% silicon, 5% copper, balance nickel and particle size within the range 140 to 325 mesh (BS 410) was made into a smooth, castable slurry using a 0.215% solution of high molecular weight cellulose, to achieve the required viscosity and denseness to prevent the powder particles settling out. The slurry was cast as a layer of approximately 0.4mm thickness on a nickel strip substrate, and dried.

After drying, a satisfactory bond was present between the cast slurry layer and the nickel substrate. The coated substrate was then subjected to compaction in a rolling mill to cause the powder content of the dried slurry layer to become at least partially embedded into the surface of the substrate.

The roll-compacted substrate was subsequently sintered at temperatures of between 900° C. and 1000° C.

If required, the resulting flat product could readily have been subjected to further cold rolling and heat treatments.

EXAMPLE 2

A pre-alloyed gas-atomised nickel alloy powder containing by weight 2% boron and 3.5% silicon, balance nickel, of particle size 140 mesh (110 microns), containing 14.5% of 325 mesh (45 microns) was made into a slurry identified in Example 1 above, and cast onto a nickel substrate. Mesh sizes referred to herein are British Mesh Standard BS 410. It will be noted that the powder used in this Example contained a higher proportion of fines than did the powder used in Example 1. The substrate coated with the cast slurry layer was compacted and a reasonable physical bond achieved. Sintering of the compacted material at a temperature of 1040° C. produced a strip in which the bond between the substrate and cast strip was satisfactory. A further compaction produced no evidence of cracking, and the integrity of the material appeared reasonable after a subsequent sinter at 1050° C.

A different substrate was then tried, namely 0.003" finished iron strip.

EXAMPLE 3

A pre-alloyed gas-atomised nickel powder containing by weight 13% Cr, 2.8% B, 4% Si, 4% Fe balance nickel of particle size less than 45 microns was made into a slurry using regular cellulose binder at a concentration of 0.7%.

A separate slurry of pure iron was produced using a cellulose binder previously found to produce a rough surface finish after sintering. One example of such cellulose binder is methyl hydroxyethyl cellulose. Samples were cast to an optimum gauge of 0.35mm, followed by rolling and sintering.

The flexible strip was then satisfactorily roll-bonded to the sintered iron substrate and subsequent sintering at various temperatures yielded an optimum temperature of 1000° C. Two further compaction and sintering stages were carried out, producing a good quality bimetal, with no signs of delamination or surface cracking.

From the foregoing Examples, it is apparent that by careful selection of the particle size of the powder and, the physical properties of the substrate (eg. relative softness, denseness etc), compaction pressures and sintering temperatures, flat products can successfully be produced from gas atomised particulate material.

It is to be understood that the foregoing description and Examples are merely exemplary of the invention descried and that modifications can readily be made to the processes described without departing from the true scope of the invention.

We claim:

1. A process for producing flat products from a start material comprising particulate material, which process comprises:

casting onto a substrate a relatively smooth slurry comprising a suspension of gas atomised particulate material in water;

drying the cast slurry coating;

roll-bonding the dried coating to the substrate;

sintering the roll-bonded product; and subsequently removing the substrate from the roll-bonded sintered product.

2. A process as claimed in claim 1 wherein the substrate is subsequently removed by a chemical pickling or electro-chemical process.

3. A process as claimed in claim 1 wherein the flat product by the process comprises a braze material.

4. A process as claimed in claim 1 wherein the substrate material comprises pure iron strip, nickel strip or nickel alloy strip.

* * * * *

UNITED STATES PATENT AND TRADEMARK OFFICE

CERTIFICATE OF CORRECTION

PATENT NO. : 4,849,163

DATED : July 18, 1989

INVENTOR(S) : John Bellis et al.

It is certified that error appears in the above-identified patent and that said Letters Patent is hereby corrected as shown below:

Column 4, line 37, delete "atomised" and insert --atomized--.

Column 4, delete line 38, insert --material in a solution of a film-forming binder material in water--.

Signed and Sealed this

Fifteenth Day of January, 1991

*Attest:*

HARRY F. MANBECK, JR.

*Attesting Officer*

*Commissioner of Patents and Trademarks*